United States Patent [19]

Moilanen

[11] Patent Number: 4,485,705

[45] Date of Patent: Dec. 4, 1984

[54] APPARATUS FOR CUTTING LUMBER

[75] Inventor: Urpo Moilanen, Heinola, Finland

[73] Assignee: A. Ahlström Osakeyhtiö, Finland

[21] Appl. No.: 378,288

[22] Filed: May 14, 1982

[30] Foreign Application Priority Data

May 15, 1981 [FI] Finland ..... 811498

[51] Int. Cl.[3] ..... B26D 3/00; B26D 5/00; B26D 7/06

[52] U.S. Cl. ..... 83/39; 83/35; 83/158; 83/404.4; 83/732; 83/419; 83/421; 83/467 A

[58] Field of Search ..... 83/33, 35, 39, 158, 83/404.4, 418, 419, 421, 467 A, 732; 144/379

[56] References Cited

U.S. PATENT DOCUMENTS

| | | | |
|---|---|---|---|
| 3,577,829 | 5/1971 | Hurn et al. | 83/419 X |
| 3,756,297 | 9/1973 | Heikinheimo | 83/35 X |
| 4,023,605 | 5/1977 | Hellström et al. | 83/419 X |

*Primary Examiner*—Paul A. Bell
*Assistant Examiner*—Taylor J. Ross
*Attorney, Agent, or Firm*—McGlew and Tuttle

[57] ABSTRACT

The invention relates to an apparatus for cutting lumber into any desired length. The cutting is carried out so that the piece of lumber is transported longitudinally, by means of a transverse conveyor, against a stop in either of two counter-check chains, which stop is connected to a carriage. The carriage can be moved in the longitudinal direction of the piece of lumber along guides by means of a servocylinder, and the position of the carriage can be suitably adjusted with respect to a circular saw next to it.

3 Claims, 2 Drawing Figures

APPARATUS FOR CUTTING LUMBER

FIELD AND BACKGROUND OF THE INVENTION

The present invention relates to an apparatus for cutting lumber into desired length, comprising a log chain conveyor or the like for shifting a piece of lumber transversally, a transverse roller assembly for shifting the piece of lumber longitudinally, a plurality of stops which are steplessly shiftable in the longitudinal direction of the piece of lumber, and a circular saw or equivalent cutting device.

Cutting apparatuses are used in lumber trimming and grading plants. They are employed for eliminating a defective portion at the end of a piece of lumber under treatment. The defective portion must be cut off the lumber as accurately as possible, according to quality grading.

A lumber cutting device is known, in particular a butt end cutter, where the piece of lumber is transported in the longitudinal direction by means of rollers, to the desired cutting point. The correct transport length is generally measured by means of a separate measuring drum.

An apparatus is disclosed in the Finnish Patent Publication No. 58 735, which is particularly a butt end cutting apparatus, for cutting lumber steplessly into desired length. Bars are connected to the parallel conveyor chains of the apparatus, to which stops or counter-checks are installed at equal intervals. These are attached to the bar with bearings, and they can be turned in front of the piece of lumber in order to obstruct the longitudinal movement thereof. Moreover, in order to make it possible that the shifting of the piece of lumber in both longitudinal and transversal direction could take place steplessly for a desired length, the bar is constructed to be adjustable in its longitudinal direction by means of a movable guide or a groove, along which groove one end of the bar moves. The cutting of the piece of lumber is carried out according to the impulse received from the grader in such a manner that the basic cutting length is suitably defined by means of the counter-checks, whereas the additional length is determined by adjusting the guide and thus by moving the whole bar.

One drawback of previously known cutting apparatuses is their relatively great inaccuracy. This is the case particularly in the first-mentioned cutter. In the latter apparatus the measuring inaccuracy has been successfully reduced, but at the same time the apparatus has become more complicated. The functional security of neither apparatus is sufficient, especially when an operation is carried out at a high processing speed.

SUMMARY OF THE INVENTION

By employing the apparatus of the present invention it is possible to avoid, among other things, the aforementioned drawbacks. The object of the invention is to provide a lumber cutting apparatus which is reliable and operates accurately in all circumstances.

Accordingly another object of the present invention is to provide an apparatus for cutting lumber by a desired length comprising a conveyor for moving a piece of lumber on a first feed path transverse to the length of the piece of lumber, a first shifting means in the first feed path for shifting the piece of lumber along its length in a second feed path, at least one guide, a carriage movable on the guide in the second feed path, drive means connected to the carriage for moving the carriage smoothly and without increments on the guide so that the carriage can assume any position on the guide along the second feed path, and at least one counter check means having a stop movable into the second feed path to stop motion of the piece of lumber in the second feed path.

Another object of the invention is to provide such an apparatus which includes cutting means positioned downstream of the carriage in a first feed path for cutting lumber which has been moved in the second feed path against the stop.

A still further object of the invention is to provide such an apparatus which includes an additional cutting means upstream of the carriage, an additional shifting means upstream of the additional cutting means for shifting a piece of lumber in a third feed path which extends longitudinally of the length of the piece of lumber and a plurality of counter check means each having a stop movable into the third feed path so that with movement of a piece of lumber along the first feed path, after it has moved along the third feed path, the additional cutting means cuts off a desired length of the piece of lumber.

It is noted that the term "steplessly" is meant to indicate a movement of the carriage on its guide in a smooth increment free manner, into any position along its path of motion.

The most important advantage of the apparatus of the invention is its simple structure. The dividing of the cutting operation into two separate phases, and the installing of preferably two parallel stops to the lightweight movable carriage during the latter phase, allows for a very accurate cutting of lumber. This is due to the fact that the mass of the carriage is small and the transport distances are short, in which case the position of the carriage, and simultaneously the final sawing point of the piece of lumber, can be adjusted quickly and accurately as desired.

BRIEF DESCRIPTION OF THE DRAWINGS

In the following the invention is explained in detail with reference to the appended drawings, wherein.

DESCRIPTION OF THE PREFERRED EMBODIMENT

Figure 1:
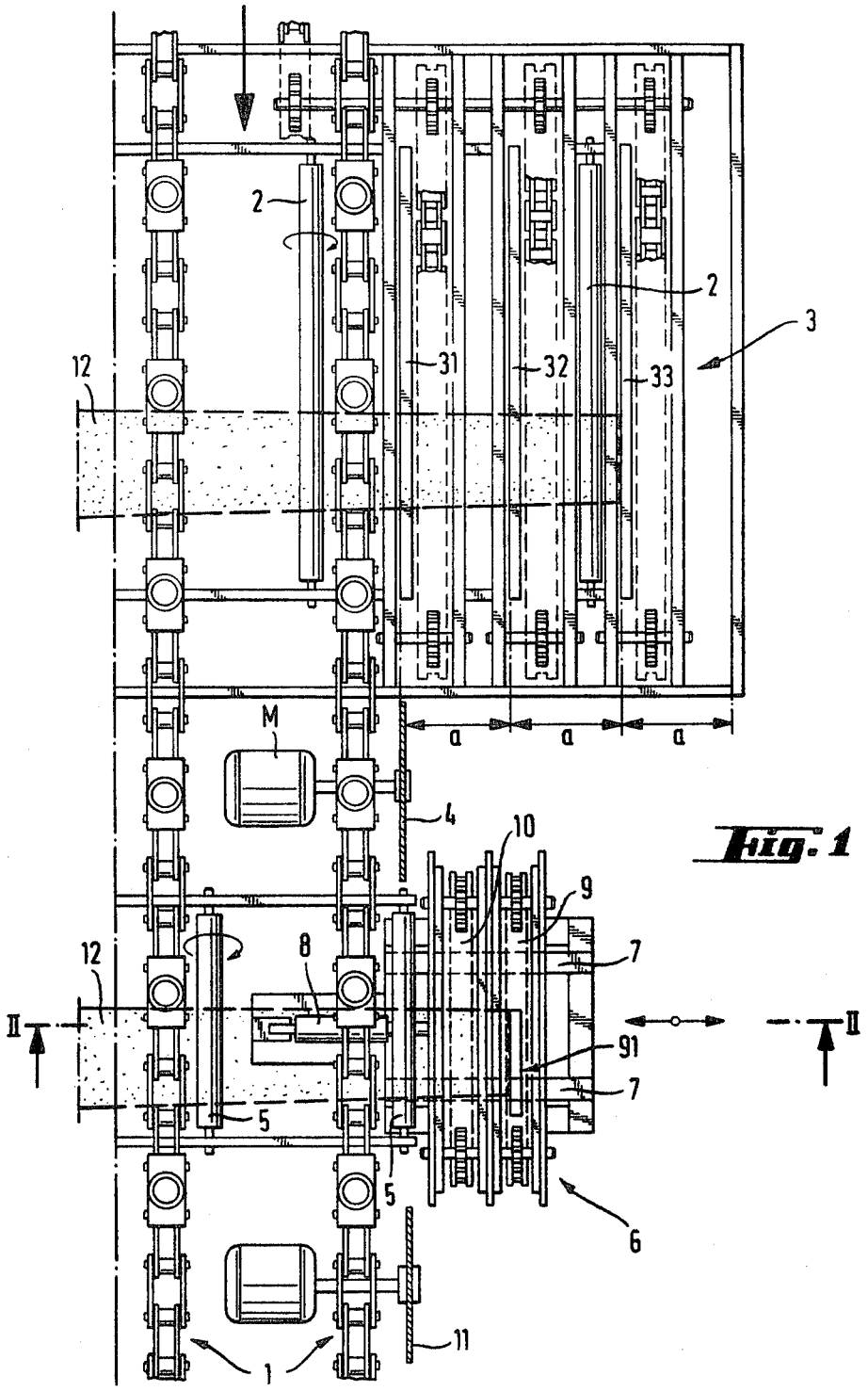
FIG. 1 illustrates one preferred embodiment of the invention seen from the top, in a top plan view.
Figure 2:
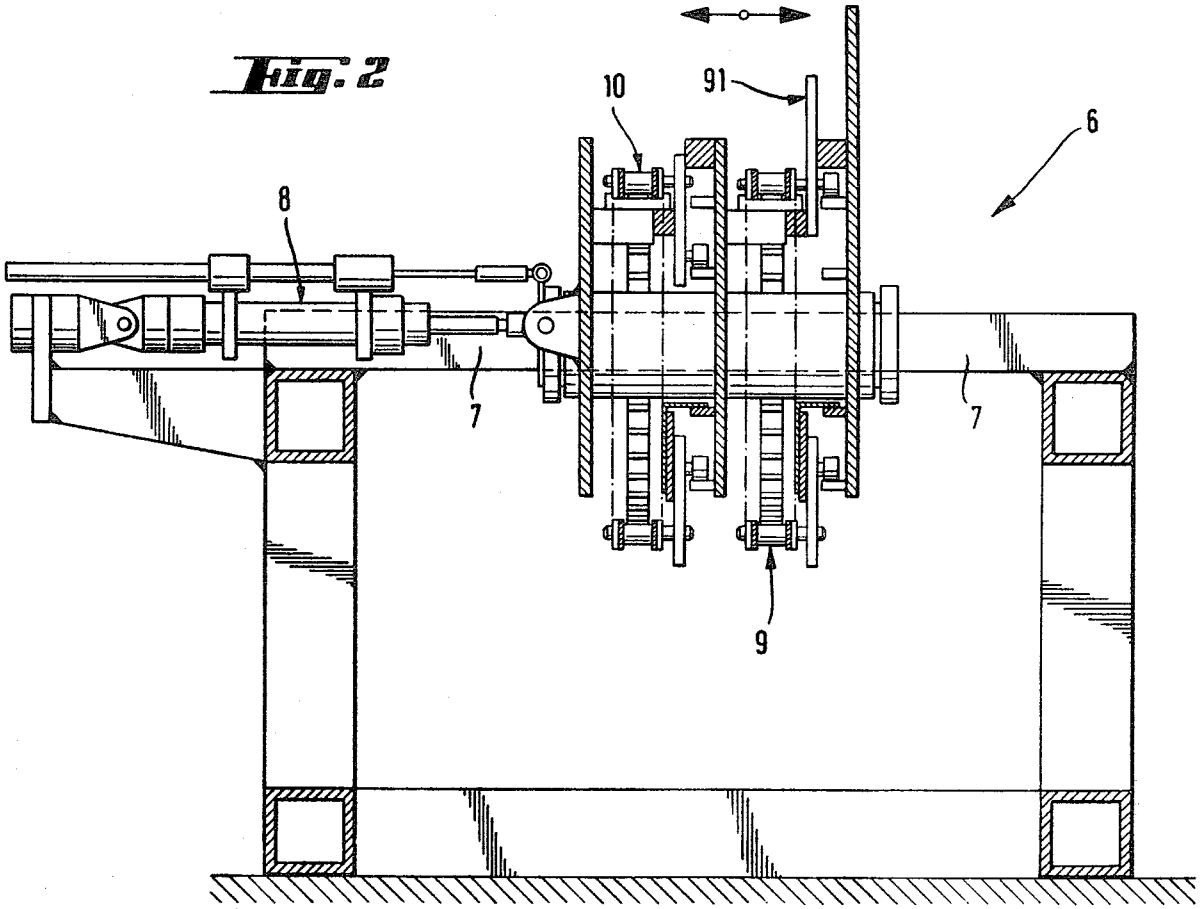
FIG. 2 illustrates the structure of the carriage seen from the side in a side elevational view.

FIG. 1 shows one application of the butt end cutting apparatus of the invention. The pieces of lumber coming from the drying house (not shown) are transported, after certain operations, in succession and one by one, by means of a suitable transverse conveyor such as a log cabin conveyor 1, into the butt end cutting phase. This takes place by shifting each piece of lumber, by means of a transverse roller assembly, against a stationary stop so that the butt ends of the pieces will all fall onto the same straight line. The turning device located on the conveyor track turns each piece of lumber over, so that the butt end grader can define the sawing point for the trimming cut of the butt end. These phases are not illustrated in the drawing.

The piece of lumber 12 is shifted by means of shifting means such as the transverse roller assembly 2 against the stop of the group of counter-checks 3 which group of counter-checks is adjusted according to the cutting impulse received from the grader (not shown) and moves in series in the longitudinal moving direction of the lumber. By employing a circular saw 4 or a similar device, the preliminary cutting of the butt end is now carried out while the piece of lumber is shifted forward in the log chain conveyor. This takes place at a certain distance a from the desired final cutting point, the distance a being the scarce interval between the group of counter-checks 3, preferably so that a=the module length=300 mm.

After the preliminary cutting, the piece of lumber 12 is moved onto the transverse roller assembly or shifting means 5. The roller assembly in turn shifts it against either of the two optional stops 91 of the counter-check chain 9, 10. Now the carriage 6 which is provided with stops, is adjusted into the desired cutting position with respect to the circular saw 11 or equivalent, which will carry out the final trimming.

The carriage 6 is arranged to move along one or several guides 7, which guides are preferably parallel to the piece of lumber, by means of a servocylinder 8 or an equivalent shifting device. The carriage 6 is provided with one or two counter-check chains 9, 10. They move synchronically forward along the log chain conveyor 1. The distance between the stops of the counter-check chains 9, 10 in the longitudinal transport direction of the piece of lumber is half of the interval a between the stops 31, 32 in the group of counter-checks 3, preferably half of the module length. Thus the shifting or adjusting length of the carriage 6 becomes relatively short, and moreover its weigth remains light. In addition to the preliminary cutting, also the location of the carriage 6 as well as the option which of the two counter-check chains 9, 10 is employed in the latter phase of the trimming, are defined according to the impulse received from the grader.

In principle the apparatus functions in the following way. When a piece of lumber has to be shortened, according to the impulse received from the grader, for instance by 820 mm, the third stop 33 of the group of counter-checks 3 is lifted, and the transverse roller assembly 2 moves the piece of lumber against the said stop. Now the circular saw 4 cuts 600 mm off the piece of lumber. The controlling device of the carriage 6 has chosen one (9) of the two counter-check chains of the carriage, lifted the respective stop 91 up and shifted the carriage outwardly the length of 220 mm−150 mm=70 mm by means of the servocylinder. The transverse roller assembly 5 transports the preliminarily cut piece of lumber against the stop 91, and the final desired trimming of 220 mm is carried out accurately by means of the circular saw 11.

If the defective portion to be cut off the end of the piece of lumber is shorter than the module length (a), the preliminary cutting is naturally unnecessary. In that case the trimming is carried out directly in the latter phase by means of the carriage 6, the stops of the counter-check chains 9, 10 therein and the circular saw 11.

The invention has been explained above with reference to one preferred embodiment only. It is naturally clear that the apparatus of the invention can be applied for various uses in a lumber trimming plant. The invention can be modified in many ways without deviating from the inventive idea presented in the patent claims. For instance, the guides can be located under the carriage, in which case the carriage 6 can be placed on the guides, on top of rollers or equivalent.

I claim:

1. An apparatus for cutting lumber by a desired length comprising:

a conveyor (1) for moving a piece of lumber on a first feed path transversely to the length of the piece of lumber;

first shifting means (5) in said first feed path for shifting the piece of lumber in a second feed path extending longitudinally of the length of the piece of lumber;

guide (7);

a carriage (6) movable on said guide in said second feed path;

drive means (8) connected to said carriage for moving said carriage to any position in said second feed path on said carriage;

two first counter-check means (9,10) connected to said carriage (6) each having a first stop (91) movable into said second feed path to stop motion of the piece of lumber on said second feed path, said first stops being spaced along said second feed path by a fraction of a modular length;

cutting means (11) positioned downstream of said carriage (6) with respect to said first feed path positioned to cut a desired length from the piece of lumber on said first feed path which desired length is set by a position of said carriage (6) on said guide (7) by said drive means (8);

second shifting means (2) positioned upstream of said carriage (6) with respect to said first feed path for moving the piece of lumber in a third feed path which is parallel to and in the same direction as said second feed path;

a plurality of second counter-check means (3) spaced along said third feed path each having a second stop (31,32,33) movable into said third feed path for stopping movement of the piece of lumber on said third feed path, said second stops being spaced along said third feed path by said modular length; and additional cutting means (4) positioned downstream of said second counter-check means and upstream of said carriage (6) with respect to said first feed path for cutting a length from the piece of lumber moving along said first feed path which is defined by one of said second stops of said second counter-check means which is in said third feed path;

each of said first counter-check means and each of said second counter-check means comprising a counter-check chain having said respective first and second stops connected thereto, each counter-check chain movable parallel to and at the same rate as said conveyor for moving each stop against which the piece of lumber engages at the same rate as the piece of lumber in said first feed path.

2. An apparatus according to claim 1, wherein said drive means comprises a servocylinder connected to said carriage.

3. An apparatus for cutting lumber by a desired length comprising:

a conveyor (1) for moving a piece of lumber on a first feed path transversely to the length of the piece of lumber;

first shifting means (5) in said first feed path for shifting the piece of lumber in a second feed path extending longitudinally of the length of the piece of lumber;

guide (7);

a carriage (6) movable on said guide in said second feed path;

drive means (8) connected to said carriage for moving said carriage to any position in said second feed path on said carriage;

two first counter-check means (9,10) connected to said carriage (6) each having a first stop (91) movable into said second feed path to stop motion of the piece of lumber on said second feed path, said first stops being spaced along said second feed path by approximately one half of a modular length;

cutting means (11) positioned downstream of said carriage (6) with respect to said first feed path positioned to cut a desired length from the piece of lumber on said first feed path which desired length is set by a position of said carriage (6) on said guide (7) by said drive means (8);

second shifting means (2) positioned upstream of said carriage (6) with respect to said first feed path for moving the piece of lumber in a third feed path which is parallel to and in the same direction as said second feed path;

a plurality of second counter-check means (3) spaced along said third feed path each having a second stop (31,32,33) movable into said third feed path for stopping movement of the piece of lumber on said third feed path, said second stops being spaced along said third feed path by said modular length; and additional cutting means (4) positioned downstream of said second counter-check means and upstream of said carriage (6) with respect to said first feed path for cutting a length from the piece of lumber moving along said first feed path which is defined by one of said second stops of said second counter-check means which is in said third feed path;

each of said first counter-check means and each of said second counter-check means comprising a counter-check chain having said respective first and second stops connected thereto, each counter-check chain movable parallel to and at the same rate as said conveyor for moving each stop against which the piece of lumber engages at the same rate as the piece of lumber in said first feed path.

* * * * *